US008333488B2

(12) United States Patent
Bailey

(10) Patent No.: US 8,333,488 B2
(45) Date of Patent: Dec. 18, 2012

(54) OPTICAL ASSEMBLY HAVING PRIMARY REFLECTOR AND SECONDARY REFLECTOR

(75) Inventor: Edward Bailey, Westampton, NJ (US)

(73) Assignee: Lighting Science Group Corporation, Satellite Beach, FL (US)

( * ) Notice: Subject to any disclaimer, the term of this patent is extended or adjusted under 35 U.S.C. 154(b) by 195 days.

(21) Appl. No.: 12/523,478

(22) PCT Filed: Jan. 17, 2008

(86) PCT No.: PCT/US2008/051302

§ 371 (c)(1),
(2), (4) Date: Jul. 16, 2009

(87) PCT Pub. No.: WO2008/089324

PCT Pub. Date: Jul. 24, 2008

(65) Prior Publication Data

US 2010/0039822 A1 Feb. 18, 2010

Related U.S. Application Data

(60) Provisional application No. 60/885,224, filed on Jan. 17, 2007.

(51) Int. Cl.
*F21V 7/09* (2006.01)

(52) U.S. Cl. ..... 362/298; 362/296.1; 362/346; 362/302; 362/306; 362/296.03; 362/800

(58) Field of Classification Search ..... 362/296.1, 362/346, 518, 298, 302, 303, 306, 296.05; 359/857–859

See application file for complete search history.

(56) References Cited

U.S. PATENT DOCUMENTS

| | | | | |
|---|---|---|---|---|
| 4,174,533 | A | 11/1979 | Barthes et al. | |
| 4,580,748 | A | 4/1986 | Dalby | |
| 6,097,549 | A * | 8/2000 | Jenkins et al. | 359/726 |
| 6,629,771 | B2 * | 10/2003 | Chiu | 362/368 |
| 6,758,582 | B1 * | 7/2004 | Hsiao et al. | 362/302 |
| 7,181,378 | B2 * | 2/2007 | Benitez et al. | 703/2 |
| 7,517,113 | B2 * | 4/2009 | Bruckner | 362/290 |
| 7,784,977 | B2 * | 8/2010 | Moolman et al. | 362/298 |
| 2003/0016539 | A1 | 1/2003 | Minano et al. | |
| 2003/0117798 | A1 * | 6/2003 | Leysath | 362/248 |
| 2005/0157503 | A1 * | 7/2005 | Lin | 362/327 |
| 2005/0169006 | A1 | 8/2005 | Wang et al. | |
| 2008/0047605 | A1 * | 2/2008 | Benitez et al. | 136/259 |

OTHER PUBLICATIONS

PCT International Search Report; International Application No. PCT/US08/51302; International Filing Date: Jan. 17, 2008; Date of Mailing: Jul. 14, 2008.

PCT International Preliminary Report on Patentability for International Application No. PCT/US2008/051302; International Filing Date: Jan. 17, 2008; Date of Mailing: Jul. 30, 2009.

* cited by examiner

*Primary Examiner* — Jong-Suk (James) Lee
*Assistant Examiner* — Leah S Macchiarolo
(74) *Attorney, Agent, or Firm* — Cantor Colburn LLP

(57) ABSTRACT

Embodiments of the present invention relate to a compact optical assembly which improves collimation of light produced by multiple LED light sources in a light engine. A shaped primary reflector located over the light engine reflects the light toward a larger shaped secondary reflector. The shapes of the reflectors are selected to cooperatively produce a highly collimated light beam. Color mixing may be improved by providing a plurality of facets on the reflective surfaces of at least one of the primary reflector or the secondary reflector.

16 Claims, 16 Drawing Sheets

| 20deg Optic OP-5LN2-0445 Illuminance chart | | Lux | | | |
|---|---|---|---|---|---|
| | **Drive Current** | **1meter** | **2** | **5** | **10** |
| NT-52D1-0430 Warm White | 1050 | 2170 | 542.5 | 86.8 | 21.7 |
| NT-52D0-0429 Daylight White | 1050 | 3292 | 823.0 | 131.7 | 32.9 |
| NT-53F0-428 RGB, Red | 1050 | 1302 | 325.5 | 52.1 | 13.0 |
| NT-53F0-0428 RGB, Green | 1050 | 1521 | 380.3 | 60.8 | 15.2 |
| NT-53F0-428 RGB, Blue | 1050 | 386 | 96.5 | 15.4 | 3.9 |
| | | | | | |
| | | | | | |
| New NRW folded reflector 10deg | | | | | |
| NT-52D0-0429 Daylight White | 1050 | 6776 | 1694 | 271.0 | 67.8 |
| | | | | | |
| | | | | | |
| | Approximate brightness improvement | | | 2.1 x | |

OPTICAL ASSEMBLY HAVING PRIMARY REFLECTOR AND SECONDARY REFLECTOR

This application claims priority from U.S. Provisional Patent Application No. 60/885,224, the entire content of which is hereby incorporated by reference in its entirety.

Numerous references including various publications may be cited and discussed in the description of this invention. The citation and/or discussion of such references is provided merely to clarify the description of the present invention and is not an admission that any such reference is "prior art" to the present invention. All references cited and discussed in this specification are incorporated herein by reference in their entirety and to the same extent as if each reference was individually incorporated by reference.

FIELD OF THE INVENTION

This invention relates to optical devices. More specifically, embodiments of the present invention relate to a folded optical system with compact free form reflectors, which collimate a multi-cavity LED light engine to a narrow beam.

BACKGROUND OF THE INVENTION

Applications for high intensity, high efficiency narrow beams are prevalent through the lighting industry. Certain industries, for instance the entertainment, architectural or theater industries, have applications for specialized lighting which can benefit from an apparatus or system which is able to collimate and control the direction at which the light is projected. In addition, there is a need to "throw" or project a selected color for a relatively long distance while maintaining an acceptable level of illumination and color uniformity. A long throw distance requires a narrow beam at a high intensity, while minimizing the intensity dispersion.

A directed light beam is light emitted in a preferred direction, and can be characterized by beam angle and dispersion. Beam width refers to the full-beam dispersion angle at which the off-axis luminous intensity of the light is one-half of the maximum on-axis luminous intensity (measured in candela), and field width refers to the full-angle at which the off-axis luminous intensity of the light has fallen to 10% of the on-axis luminous intensity. Dispersion is a measure of the distribution of the luminous intensity over the beam angle. The throw distance is increased when the emitted light is concentrated into a small beam angle with a small dispersion.

Conventional LED arrays produce light emissions having a relatively wide Lambertian beam angle of, e.g., 120°. The conventional LED arrays can be coupled with primary optics, thereby capable of forming, for example, an LED light engine in a 1.5×1.5 inch package and producing a light beam having an intensity of 1,000 lumens over a still wide beam angle of 60°, such as the Lamina Lighting Titan™, suitable for some residential, stage, architectural, and commercial lighting applications. Such light engines typically include multiple emitters and cavities to produce a light beam having an acceptable intensity, however this increases the apparent source size to be much larger than the apparent source size from a single emitter light engine, thereby making it more difficult to collimate the light into a beam having a low level of intensity dispersion.

Conventional collimation solutions which are tall (e.g., ≧5") or wide (e.g., ≧6") are too costly to manufacture, ship, and install when the light source itself is already two to three times the cost of energy-inefficient incandescent and halogen sources that it replaces. A compact, low-cost collimation design is preferable for applications where space or cost considerations dominate. Therefore, a need exists to provide a compact, low-cost optics assembly which can optimize the collimation and throw distance of a light beam produced by a light engine.

SUMMARY OF THE INVENTION

According to the present invention, an optical assembly produces a narrow beam by replacing a single tall reflector with a compact optical system including two revolved spline reflectors, e.g., ≦2" tall and ≦5" wide. Micro-facets on the reflectors improve the uniformity of the beam with a minimal degradation in intensity dispersion. Light emitted by the LEDs passes through an optical assembly including the optical features of a primary reflector and a secondary reflector, the reflectors having predetermined shapes which cooperatively match in order to produce a light beam having a desired amount of collimation.

A device in accordance with an embodiment of the present invention preferably includes one or more of the following assembly design features or functions:

1) a light engine mounted on a substantially planar substrate, the light engine having multiple light emitters, each light emitter situated within a cavity, in which the light produced by the light engine is produced having a predetermined beam angle, and directed along a predetermined direction;

2) a secondary reflector having a substantially concave shape, oriented having a central axis substantially perpendicular to the substrate, having an entrance aperture, and an exit aperture at the top of the concave shape, the entrance aperture may be co-planar with the substrate and enclosing the light engine, and one or more mounting locations adjacent to the exterior of the exit aperture;

3) a plurality of support struts, each having a lower end attached to the substrate, and an upper end attached to a mounting portion of the secondary reflector;

4) one or more support spars, each support spar having an outer end attached to a mounting portion of the secondary reflector, and having an inner end extending toward the central axis of the secondary reflector;

5) a primary reflector attached to the inner end of a support spar, the primary reflector having a reflective surface facing the light engine, the support spar suspending the primary reflector within the predetermined beam angle of the light engine.

BRIEF DESCRIPTION OF THE DRAWINGS

Embodiments of the present invention will be more readily understood from the detailed description of exemplary embodiments presented below considered in conjunction with the accompanying drawings, in which.

DETAILED DESCRIPTION OF THE INVENTION

Figure 1:
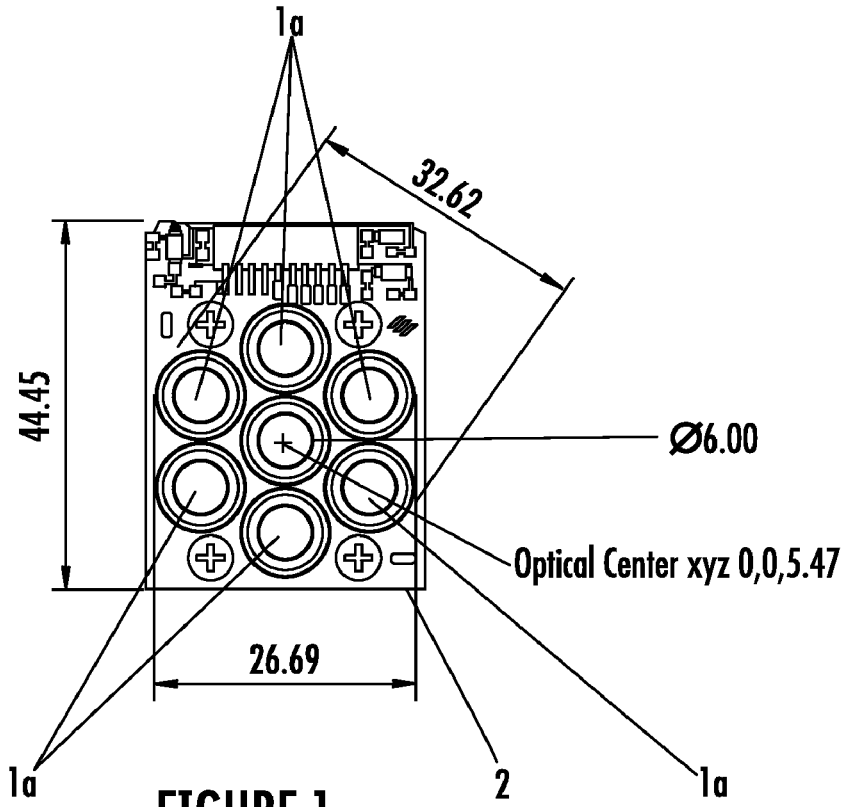
FIG. 1 is a top view of a light engine, showing exemplary dimensions and LED placement locations within the light engine.
Figure 2:
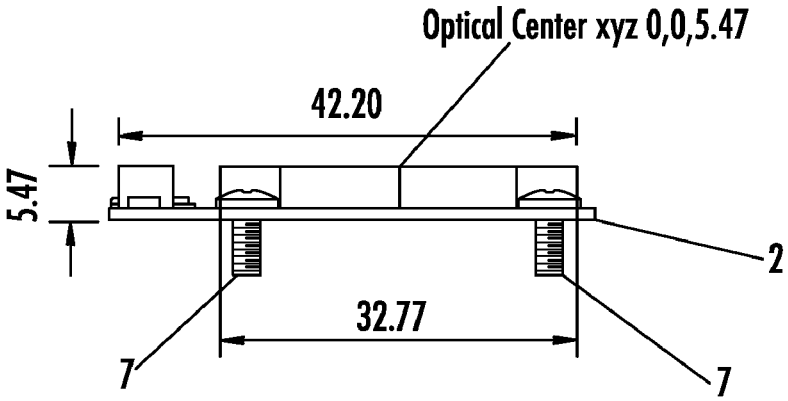
FIG. 2 is a side view of a light engine, showing exemplary dimensions and locations of the substrate and mounting fasteners supporting the light engine.

FIG. 1 is a top view of LED placement locations within a plurality of light engine cavities in accordance with an embodiment of the present invention. Preferably, the cavities have a reflective inner surface, and each cavity has a light extraction lens encapsulating the LED. The individual LEDs 1*a* may be a blue excitation emitter with wavelength 440-495 nm, a direct emission red, orange, or amber excitation emitter with wavelength range 575-680 nm, or a direct emission green wavelength excitation emitter having a range 495 nm-575 nm. White light may be produced by exciting a yellow phosphor with light from blue LEDs. The LEDs are typically mounted on a substrate 2 which provides electrical connections, thermal dissipation, and mechanical support. Placement and quantity of LEDs 1*a* may vary from the placement shown in FIG. 1. Typical dimensions in millimeters of the light engine are shown in FIG. 1. For instance, the light engine of FIG. 1 is shown having an optical axis coincident with the central LED, and having an optical center at (x,y,z) coordinates of (0, 0, 5.47) mm, in which the Z-axis is measured from the surface of the substrate 2. The diameter of the central reflective cavity is 6.00 mm as indicated in FIG. 1. The diameter of each reflective cavity is similar, but it will be understood by those skilled in the art that the diameter of each reflective cavity may vary by ±0.5 mm or more, and each cavity may have a similar but different diameter.

Figure 3:
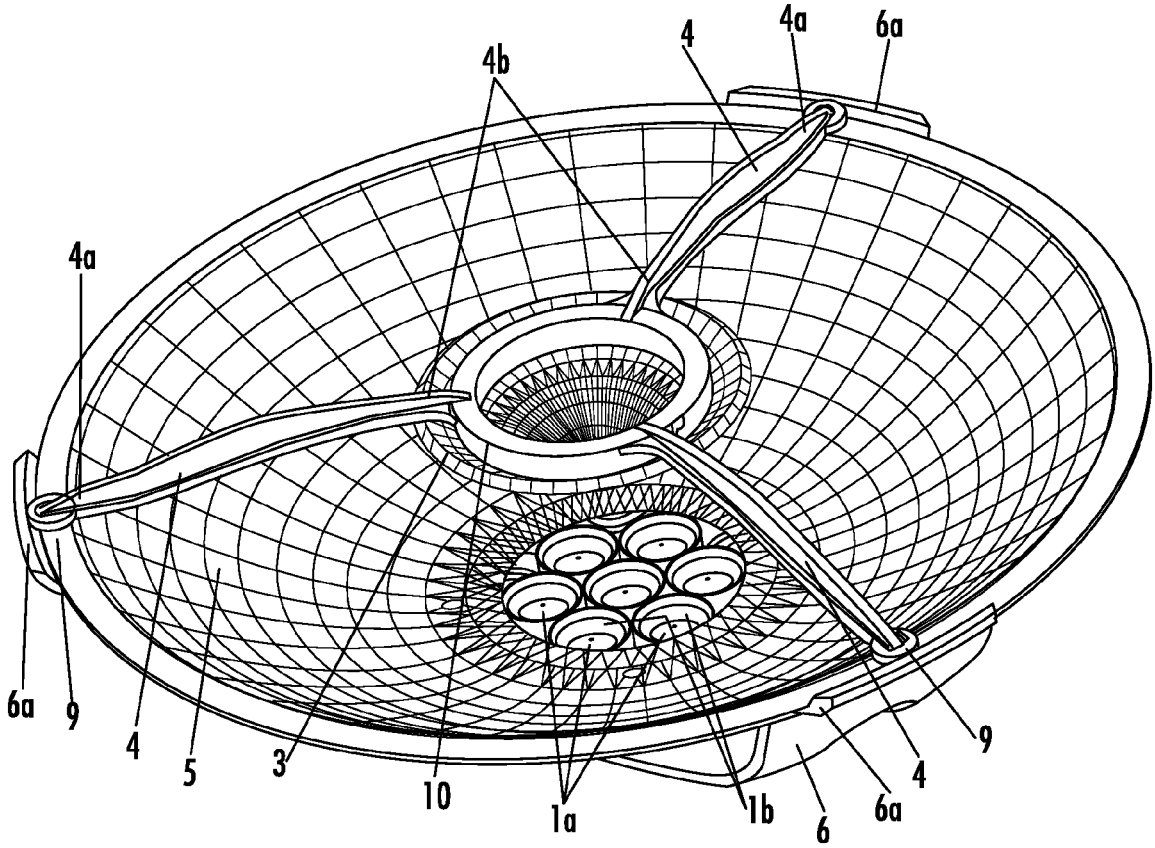
FIG. 3 is a perspective view of the folded optic of an embodiment of the present invention.

FIG. 3 shows a perspective view of one embodiment of the present invention, having the following features designed to enhance the collimation and mixing of light, with each of these features discussed in greater detail below: light engine 1 having a plurality of LEDs 1*a* (not all LEDs 1*a* are labeled); folded path faceted primary reflector 3; support spars 4; faceted secondary reflector 5; support struts 6. The light engine 1 has a plurality of LEDs and is preferably the light engine shown in FIG. 1.

Figure 4:
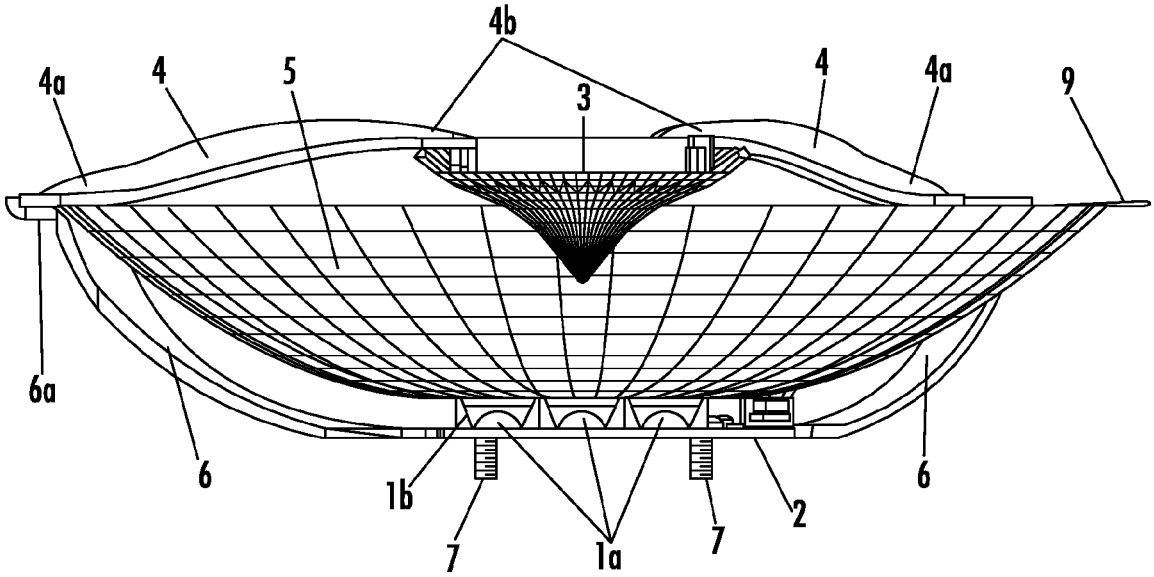
FIG. 4 is a cross-sectional view of the folded optic of an embodiment of the present invention.

FIG. 4 shows a cut-away side view of one embodiment of the present invention, additionally showing the substrate 2 and mounting fasteners 7 which may be screws, bolts, or the like in any combination.

Structure of the Optical Assembly

Referring to FIGS. 3 and 4, the optical assembly includes a substrate 2, on which a plurality of LEDs 1*a* are mounted, forming a light engine 1 (not labeled in FIG. 4) such as the light engine 1 shown in FIG. 1. Each LED 1*a* is situated within a cup-like cavity 1*b* having reflective interior walls. The tops of the cup-like cavities 1*b* are co-planar in a plane parallel to substrate 2, and also co-planar with the bottom of a secondary reflector 5. In a preferred embodiment, the bottom of secondary reflector 5 has an opening which is seen more clearly in FIG. 3.

Referring to both FIGS. 3 and 4, secondary reflector 5 is an upwardly concave structure having a reflective inner surface. In one embodiment, secondary reflector 5 has two openings. The first opening of secondary reflector 5 is an entrance aperture that forms an opening which surrounds the light engine 1, through which light enters the secondary reflector 5. The second opening is at the top of secondary reflector 5 and is an exit aperture from which light emerges. Adjacent to the exit aperture at one or more points, and on the exterior side of secondary reflector 5, is a mounting area 9, shown in FIG. 3 as a flat lip encircling the exit aperture of secondary reflector 5. Mounting area 9 need not completely encircle the exit aperture of secondary reflector 5, and may be more than one mounting area 9 unconnected to each other and located at different points around the perimeter of the exit aperture.

Under the secondary reflector 5 are two or more support struts 6, which stabilize and provide physical support to secondary reflector 5. The preferred configuration is three support struts 6 approximately equally-spaced, as shown in FIG. 3. The lower end of support strut 6 is attached to substrate 2. The upper end of support strut 6 includes a strut head 6*a*, which engages with mounting area 9, thereby stabilizing and providing physical support to secondary reflector 5. Strut head 6*a* may optionally include a locking portion which has limited flexibility, in which at least part of the locking portion may be physically snapped over at least a portion of the top of the mounting area 9, exerting a compression force between the locking portion of strut head 6*a*, mounting area 9, and the remainder of strut head 6*a,* thereby further stabilizing and providing physical support to secondary reflector 5.

Those skilled in the art will recognize that other means may be used to position, support, and align the secondary reflector 5 with respect to the primary reflector 3, e.g., a truss; or support ribs embedded in secondary reflector 5; or if secondary reflector 5 provides adequate stiffness then no additional support may be required.

In one embodiment, a first end 4*a* of one or more support spars 4 is attached to the mounting area 9, preferably at a location of mounting area 9 that is supported by a support strut 6. The means of attaching support spar 4 to the mounting area 9 may include bonding with an adhesive, or by having a portion of support spar 4 located between mounting area 9 and the locking portion of strut head 6*a*, thereby causing the first end 4*a* of support spar 4 to be physically held in place by the compression force exerted by the locking portion of strut head 6*a*.

In other embodiments, the first end 4*a* of the one or more support spars 4 may be attached to one or more struts 6, or directly to the substrate 2.

The second end of support spar 4 is attached to mounting ring 10. The means for attaching support spar 4 to mounting ring 10 may include adhesive, a physical snap connection similar to that which may be used to attach the locking portion of strut head 6*a* to the secondary reflector 5, or any combination of such methods. The lower surface of mounting ring 10 is attached to the upper surface of the folded path primary reflector 3.

The folded path primary reflector 3 is a structure having a reflective surface facing the light engine 1, and having a cross-section at least partially within the beam width produced by the light engine 1. Support spar 4 acts to hold the folded path primary reflector 3 in the required position within the beam width of light engine 1, and with the required degree of stability. Although one or two support spars 4 may be adequate to hold the folded path primary reflector 3 if the support spars 4 have adequate stiffness, three support spars 4 are preferred in order to provide a more stable support.

Preferred embodiments of the optical assembly are compact and low profile but may exhibit reduced efficiency due to light blockage by the support spars 4 and some uncaptured light from light engine 1 that does not strike both the folded path primary reflector 3 and secondary reflector 5.

Operation of the Optical Assembly

Figure 5:
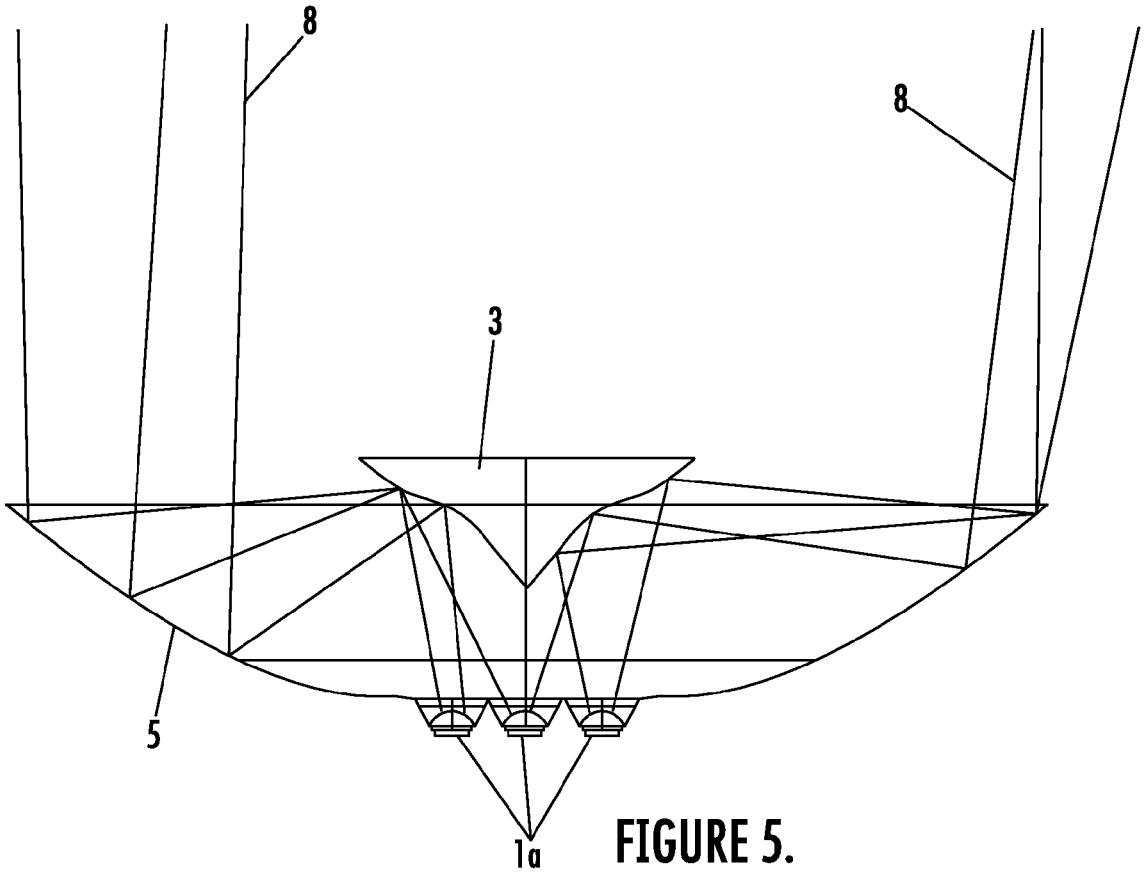
FIG. 5 is a raytrace diagram of light produced by an embodiment of the present invention.

FIG. 5 illustrates the operation of the optical assembly by presenting a raytrace of representative light rays 8 traveling through an embodiment of the present invention. Light emitted by the LEDs 1*a* strikes the folded path primary reflector 3, and is reflected by its reflective surface. The reflected light rays then strike the secondary reflector 5 and are reflected, thereby forming a light beam having the desired level of intensity and collimation. The operation of the optical assembly is presented below in greater detail.

Referring to FIG. 3, light is generated by the LEDs 1*a* of the light engine 1. Each LED is located within a cup-like cavity 1*b*. The interior walls of cavities 1*b* are reflective, and act to restrict the light produced by the light engine 1 to within a beam angle, e.g., approximately 60°, oriented upward.

Figure 6:
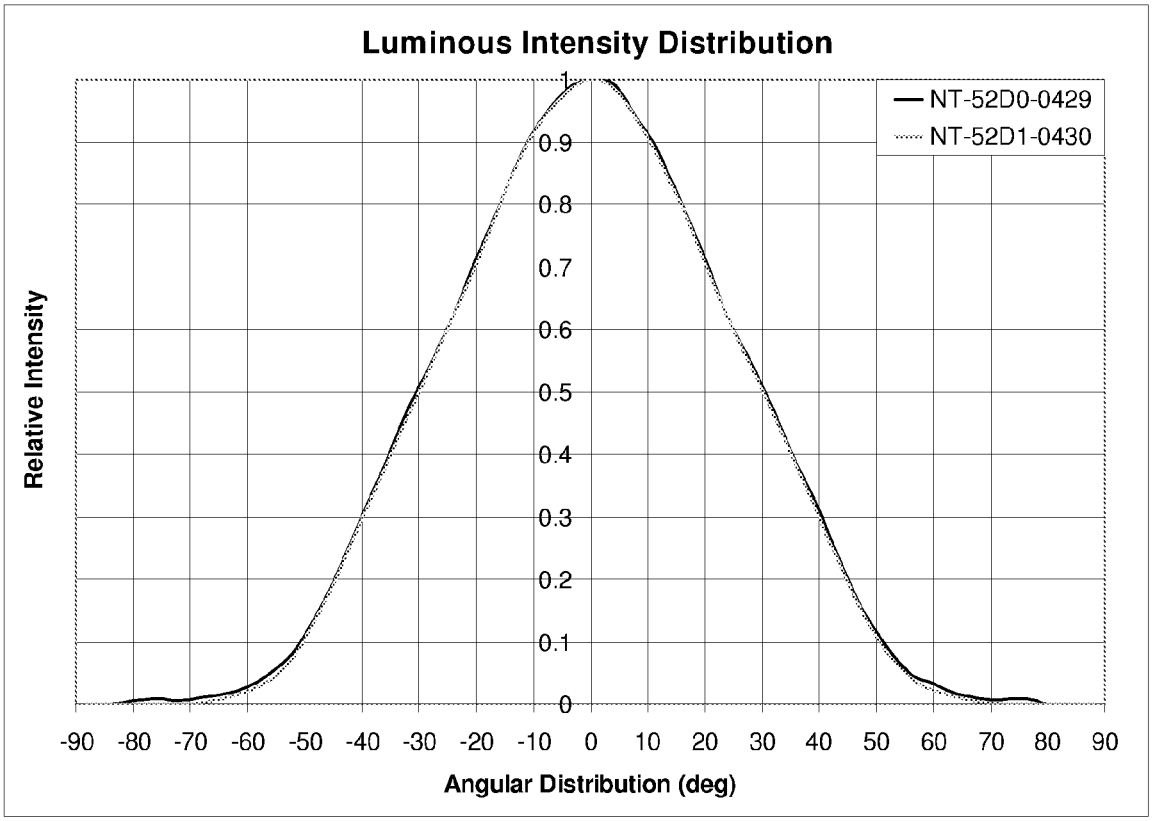
FIG. 6 is a plot of the luminous intensity distribution for the light engine of FIGS. 1-2, showing a beam angle of approximately 60°.

Light emitted from the LEDs 1*a* superimposes to produce a beam of light having a desired level of uniformity. In one embodiment, generally acceptable uniformity includes an illuminance distribution which deviates by less than 20% within 5° of the optical axis of the light engine system. The field width of the intensity dispersion is 100°. FIG. 6 shows the typical luminous intensity distribution emitted by an exemplary Titan™ light engine at a typical far field distance of 1 meter or approximately 6 times the distance of the maximum diameter of the collimation system.

The primary reflector 3 is located within the beam angle of light from the light engine 1. The primary reflector 3 has a reflective surface facing the light engine 1 which may include facets to improve the light mixing. The facets include a simple tessellation (i.e., a repeating pattern) of the spline from a continuously varying function to that of a discrete function. The facets are flat. Faceting may also be included on the reflective surface of the secondary reflector 5. Table 1 presents five embodiments of facet design. The design of facet level 0 provides a relatively small number of larger facets, progressing to facet level 4 which provides a relatively large number of smaller facets.

TABLE 1

| Reflector Facets | | | |
|---|---|---|---|
| Facet Level 0-4 | Primary Reflector Facet # | Secondary Reflector Facet # | Total Facet # |
| 0 | 11 | 26 | 37 |
| 1 | 72 | 54 | 126 |
| 2 | 264 | 104 | 368 |
| 3 | 2115 | 720 | 2835 |
| 4 | 5500 | 1650 | 7150 |

The preferred embodiment of facet design among the levels of Table 1 is facet level 3, having 2,835 facets, providing a preferred combination of simple facets producing a 10° beam with acceptable uniformity. Persons skilled in the art will recognize that the number of facets of each facet level may be varied 5-10% from the exact values given in Table 1 without producing an unacceptable change in beam width or uniformity from that of the nearest facet level. Generally, the higher the number of facets the lower the intensity dispersion and uniformity.

Optical devices and features for controlled color mixing developed by the applicant, including faceting, are known and described in commonly-assigned U.S. patent application Ser. No. 11/737,101, the entire content of which is incorporated by reference herein in its entirety.

Figure 21:
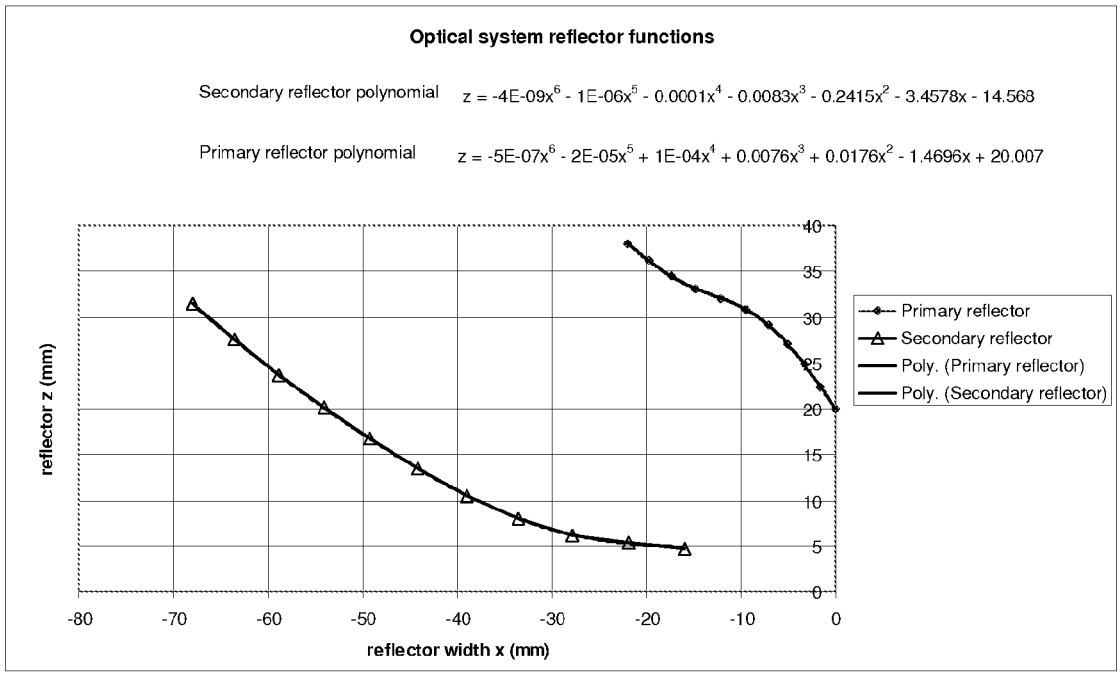
FIG. 21 is an approximate polynomial fit of the bezier splines which form an embodiment of the cross-sectional profiles of both the primary reflector and the secondary reflector.

The primary reflector 3, aside from the faceting, is rotationally symmetric, having an approximate shape similar to a cone having a narrow end pointed toward the light engine 1. More specifically, the primary reflector 3 has a cross-sectional profile in the X-Z plane described as a free-form bezier spline. FIG. 21 shows an approximate polynomial fit of the bezier splines which form an embodiment of the cross-sectional profiles of both the primary reflector 3 and the secondary reflector 5.

Light emitted by the light engine 1 at an angle of approximately 45° to 90° with respect to the surface of substrate 2 will reflect from the primary reflector 3 toward the secondary reflector 5. Light emitted by the light engine 1 at an angle of approximately 0° to 30° will strike the secondary reflector 5 directly and be reflected to the side, forming side light. Light emitted by the light engine 1 at an angle of approximately 30° to 45° is uncaptured spill light.

Both side light and spill light are undesirable because they lessen the amount of light in the main beam produced by the optical assembly. In order to lessen the amount of spill light, the angle of emissions from light engine 1 that produces spill light can be reduced by constraining the optic assembly into as low a profile as possible.

Figure 20:
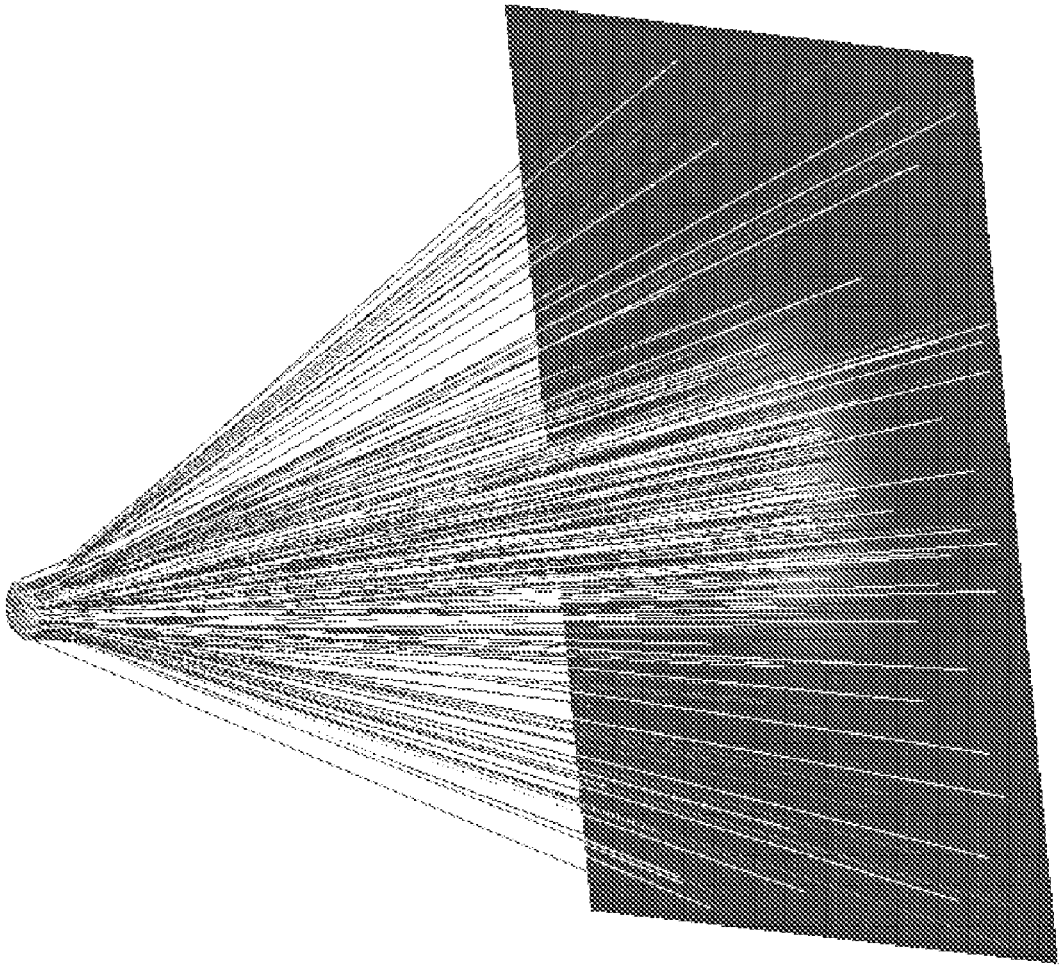
FIG. 20 is a raytrace plot of a light beam produced by an embodiment of the present invention.

The secondary reflector 5 is generally of an upwardly concave shape with a reflective inner surface facing the primary reflector 3. The secondary reflector 5 has a cross-sectional profile in the X-Z plane which is more precisely described as a free-form bezier spline. The secondary reflector 5 receives light reflected by the primary reflector 3, and reflects the light upward with the desired amount of collimation by performing a cosine correction by which collimation of the light is improved. The secondary reflector 5 may include facets on its inner surface, thereby improving the uniformity of the light beam reflected from the secondary reflector 5 with minimal degradation to intensity dispersion. The facets are produced by converting a circle into a polygon by dividing the 360 degrees of the circle into "N" segments of approximately equal size, where N is the number of sides of the polygon. The facets are simple square facets having a flat surface shape. Support spars 4 block a small portion of the light. FIG. 20 shows a typical calculated raytrace diagram of light emitted from an embodiment of the present invention, having a beam angle of 10°.

Figure 7:
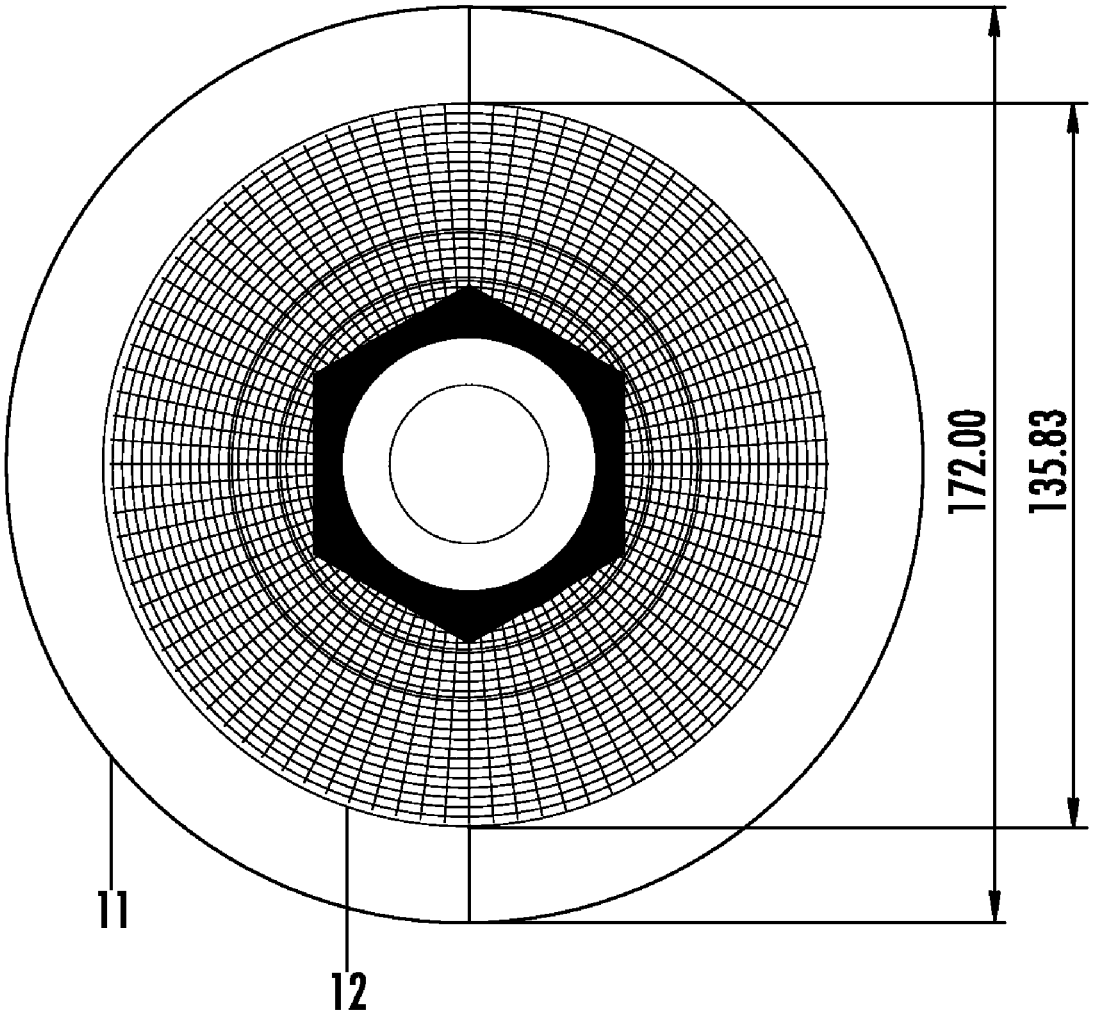
FIG. 7 is a top view comparison of the folded optic of an embodiment of the present invention, overlaid on the footprint of conventional narrow collimation optics.
Figure 8:
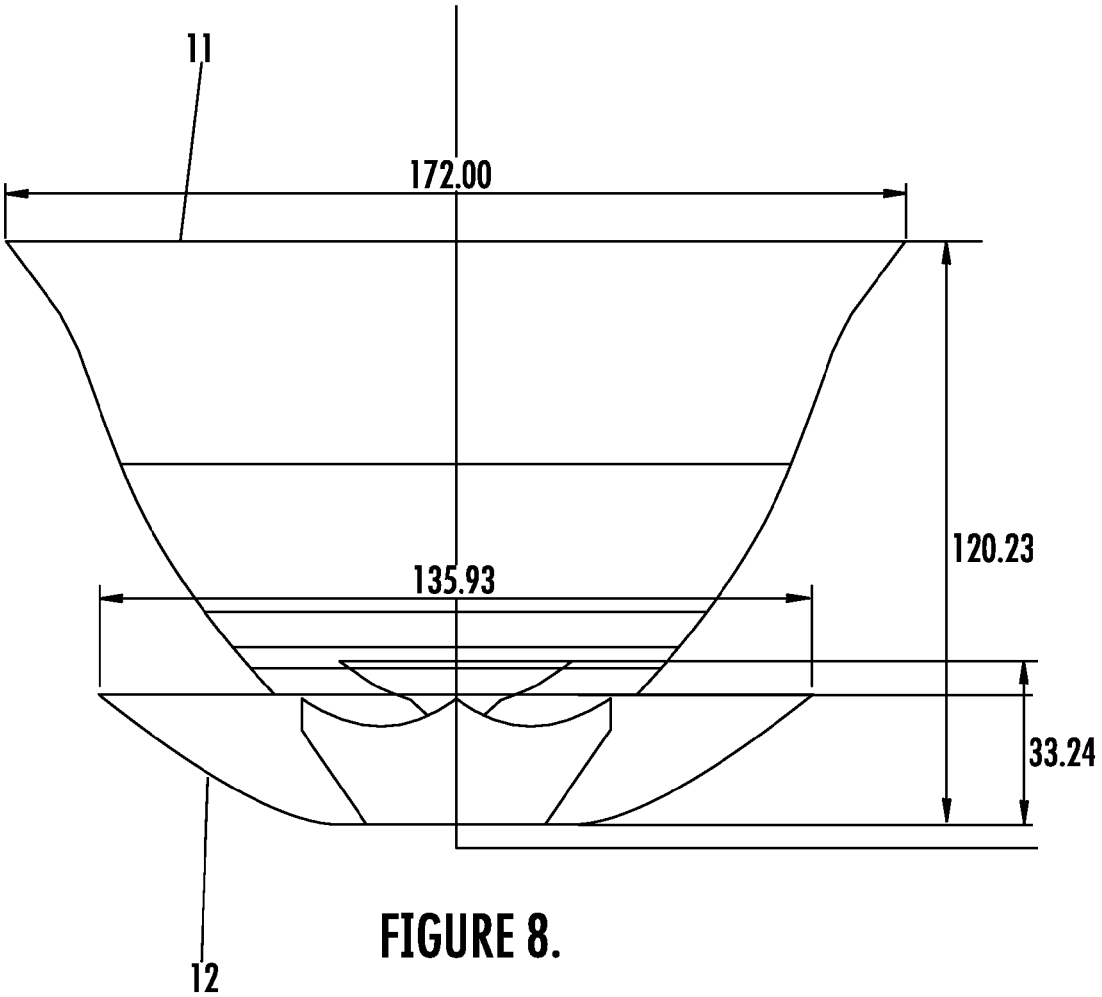
FIG. 8 is a side view comparison of the folded optic of an embodiment of the present invention, overlaid on the profile of conventional narrow collimation optics.

Embodiments of the present invention provide a more compact assembly compared to the prior art. FIG. 7 shows a comparison of the cross-section in the X-Y plane of the prior art 11 and an embodiment 12 of the present invention. FIG. 8 shows a similar comparison of cross-sections in the X-Z plane.

Figure 9:
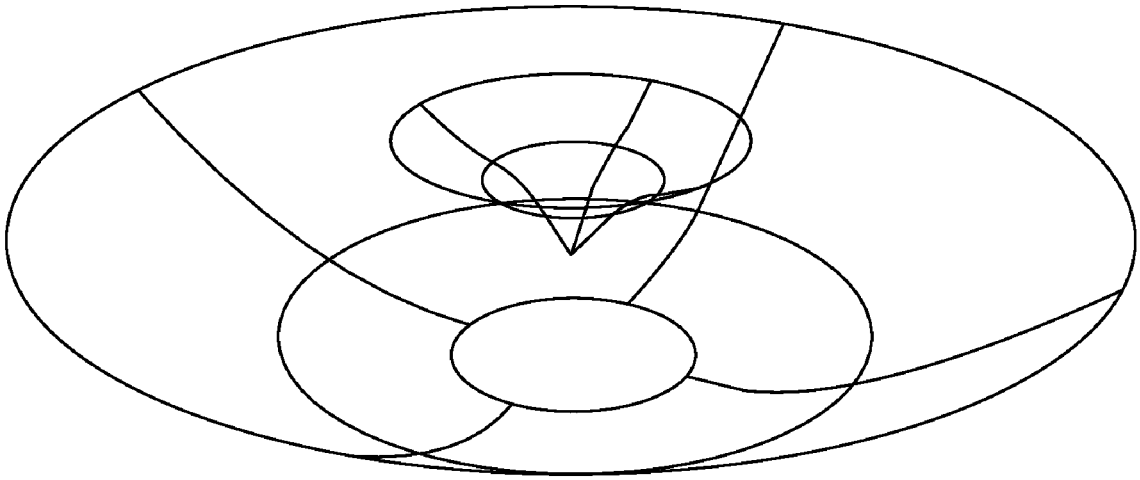
FIG. 9 is a wire-frame view of the primary reflector and secondary reflector of an embodiment of the present invention, without facets on the reflector surfaces.
Figure 10:
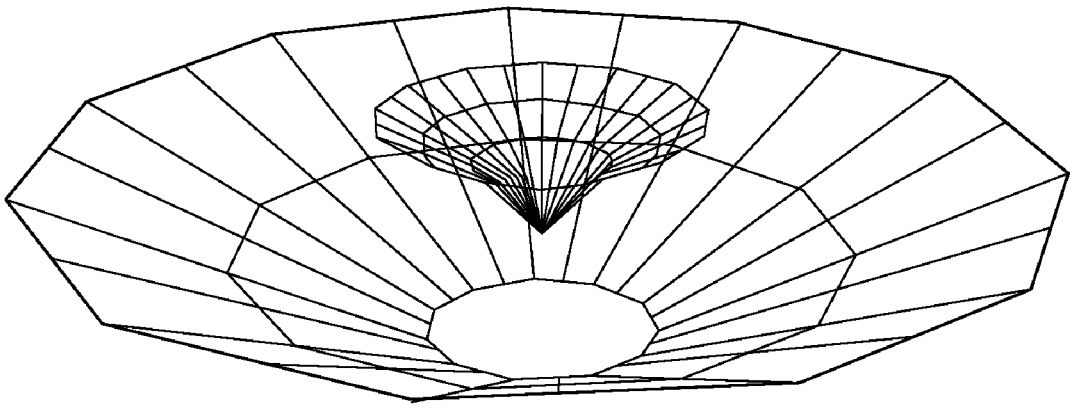
FIG. 10 is a wire-frame view of a first embodiment of the primary reflector and secondary reflector of an embodiment of the present invention, having 37 facets on the reflector surfaces.
Figure 11:
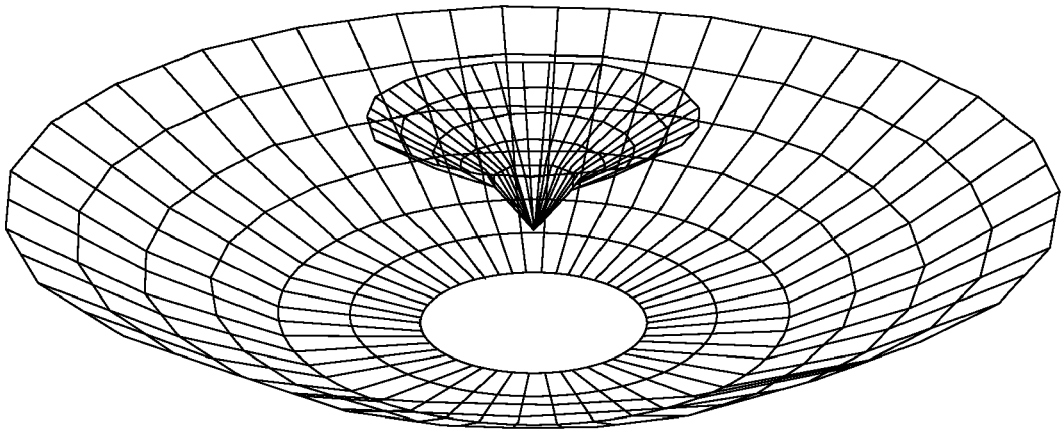
FIG. 11 is a wire-frame view of a second embodiment of the primary reflector and secondary reflector of an embodiment of the present invention, having 126 facets on the reflector surfaces.
Figure 12:
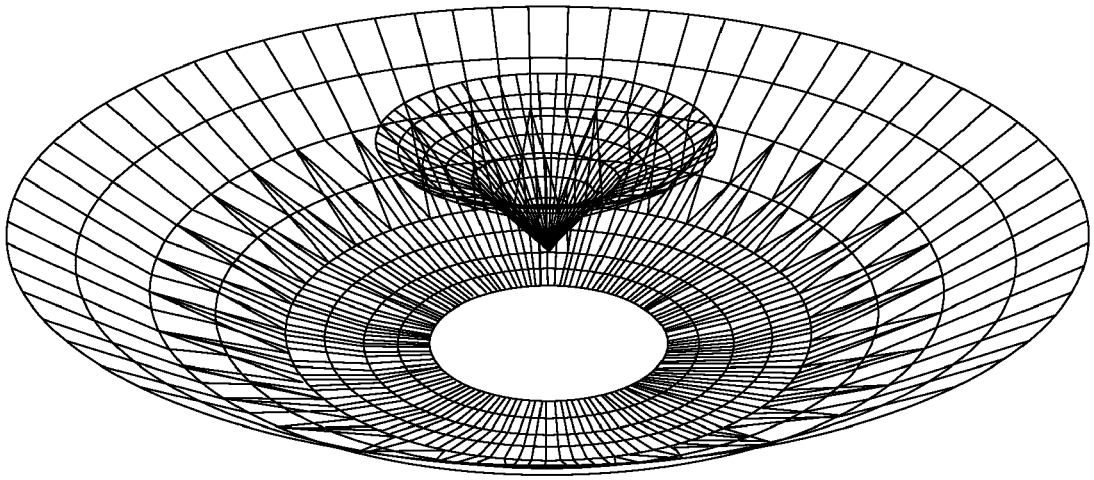
FIG. 12 is a wire-frame view of a third embodiment of the primary reflector and secondary reflector of an embodiment of the present invention, having 368 facets on the reflector surfaces.
Figure 13:
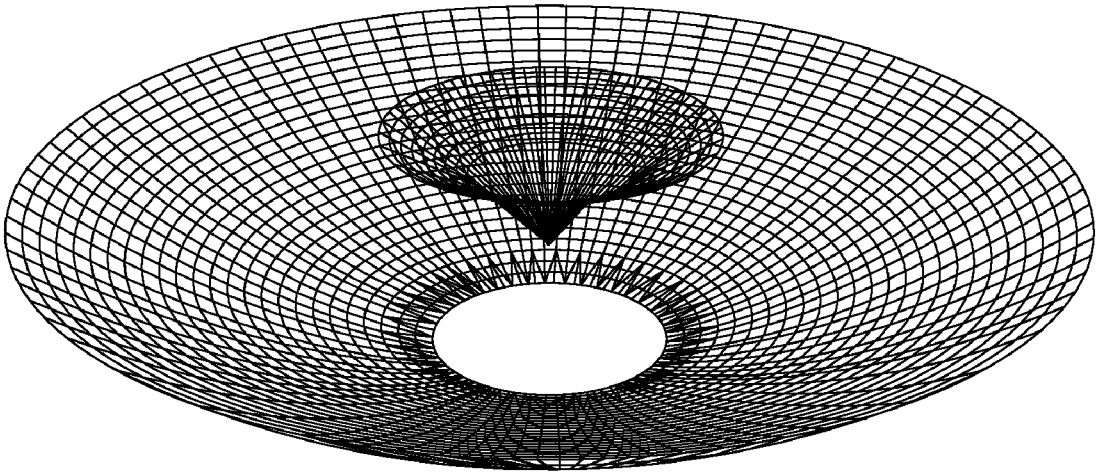
FIG. 13 is a wire-frame view of a fourth embodiment of the primary reflector and secondary reflector of an embodiment of the present invention, having 2835 facets on the reflector surfaces.
Figure 14:
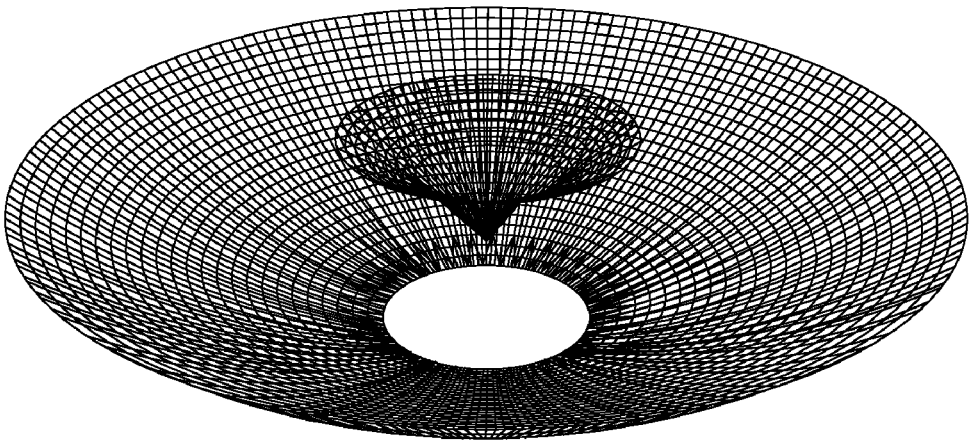
FIG. 14 is a wire-frame view of a fifth embodiment of the primary reflector and secondary reflector of an embodiment of the present invention, having 7,150 facets on the reflector surfaces.
Figure 15:
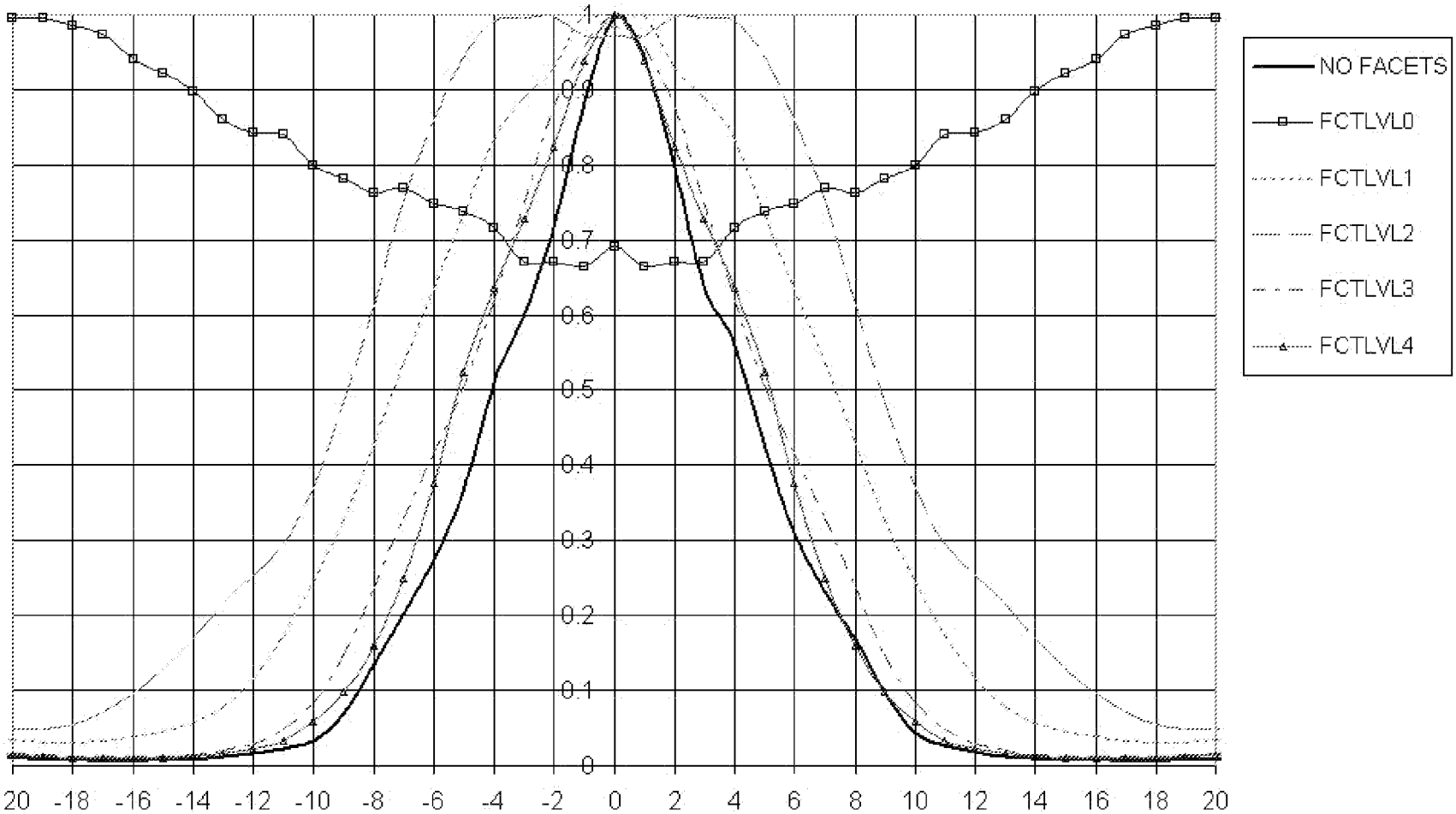
FIG. 15 is a plot of the relative intensity distribution for the various faceting patterns shown in FIGS. 10-14.

FIG. 9 shows a wireframe view of an embodiment of the present invention, without facets. FIGS. 10-14 show wireframe views of additional embodiments of the present invention, showing increasing numbers of facets on the primary reflector 3 and the secondary reflector 5. FIG. 15 shows a comparison of the resulting intensity distributions for the embodiments shown in FIGS. 9-14, in which the Y-axis is the normalized relative intensity and the X-axis is degrees off the main axis of the beam of light. FIG. 15 depicts the impact of facet size on intensity dispersion. Coarse facets which roughly discretize the smoothly revolved bezier spline architecture of the optical reflectors widen the intensity dispersion dramatically, whereas smaller facets disrupt the dispersion of the light less.

Figures 16, 17:
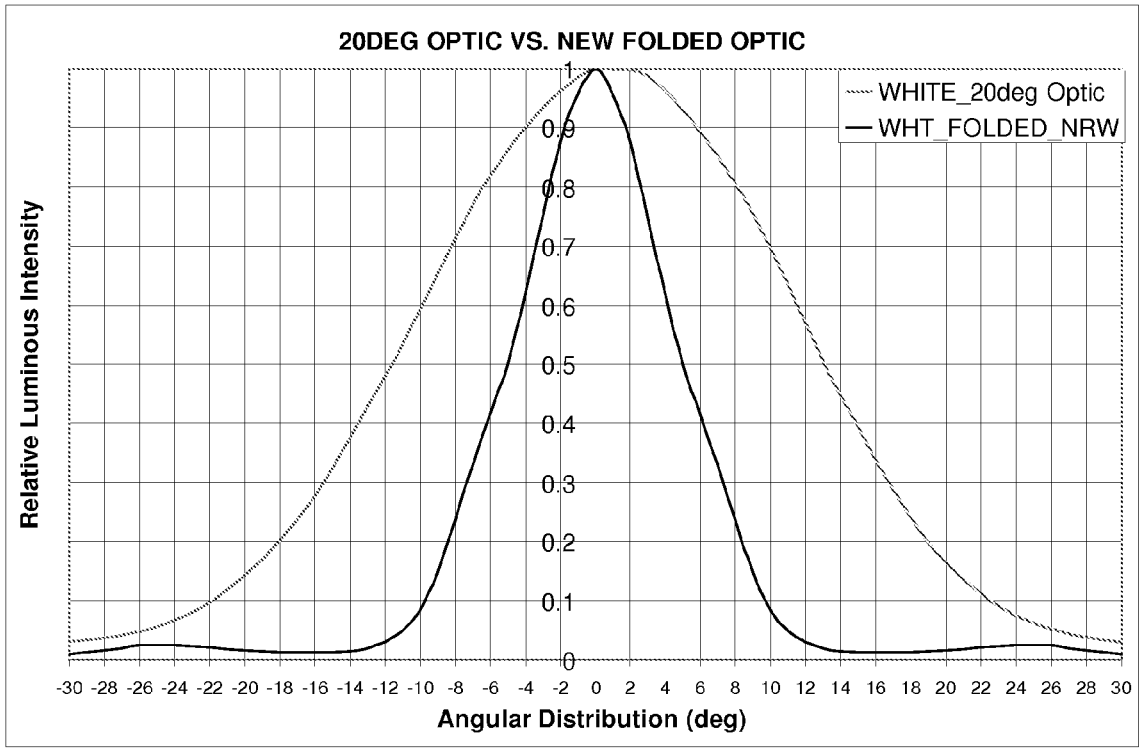
FIG. 16 is a comparative plot of the beam angle of conventional optics, compared to the beam angle for an embodiment of the present invention.
FIG. 17 is a table of supporting data showing an approximately 2.1-fold improvement in illuminance at a predetermined distance from the light engine, compared to the prior art.

FIG. 16 shows a comparison of relative intensities of the improved light collimation available with embodiments of the present invention, compared to 20° narrow optics known in the prior art. The improved collimation allows the light to be projected further.

FIG. 17 shows a comparison of the illuminance of specific 20° narrow optics known in the prior art with that of embodiments of the present invention, at distances of 1, 2, 5 and 10 meters. An embodiment of the present invention converts the 60° primary beam of light exiting a 7-cavity LED light engine array into a 10° beam of light. The 10° intensity dispersion throws more illuminance (units of Lux) over a greater distance than either a 20° optic, or the 60° beam from the stock light engine. At a 10 meter distance, an embodiment of the present invention throws 68 Lux when the primary light engine produces 850 source lumens.

Figure 18:
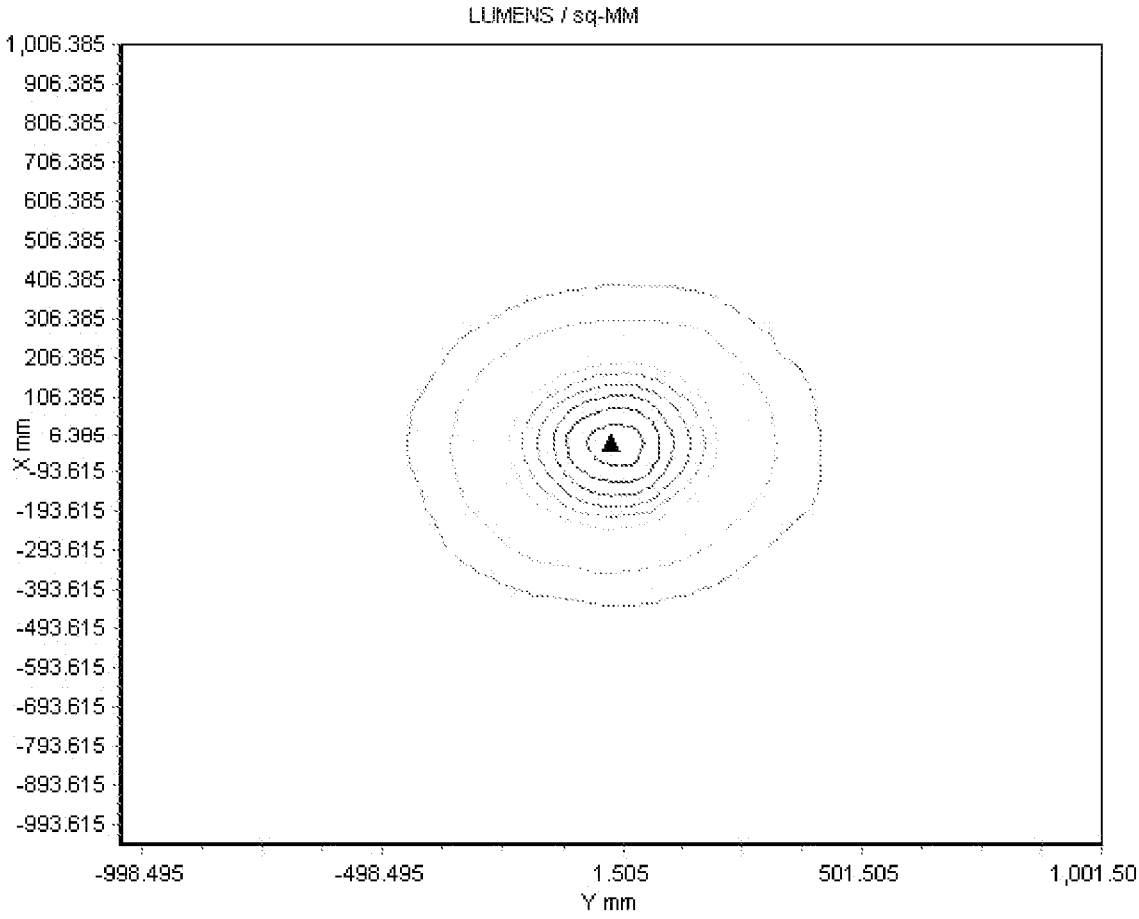
FIG. 18 is a relief plot of the intensity in the X-Y plane of a light beam produced by an embodiment of the present invention.
Figure 19:
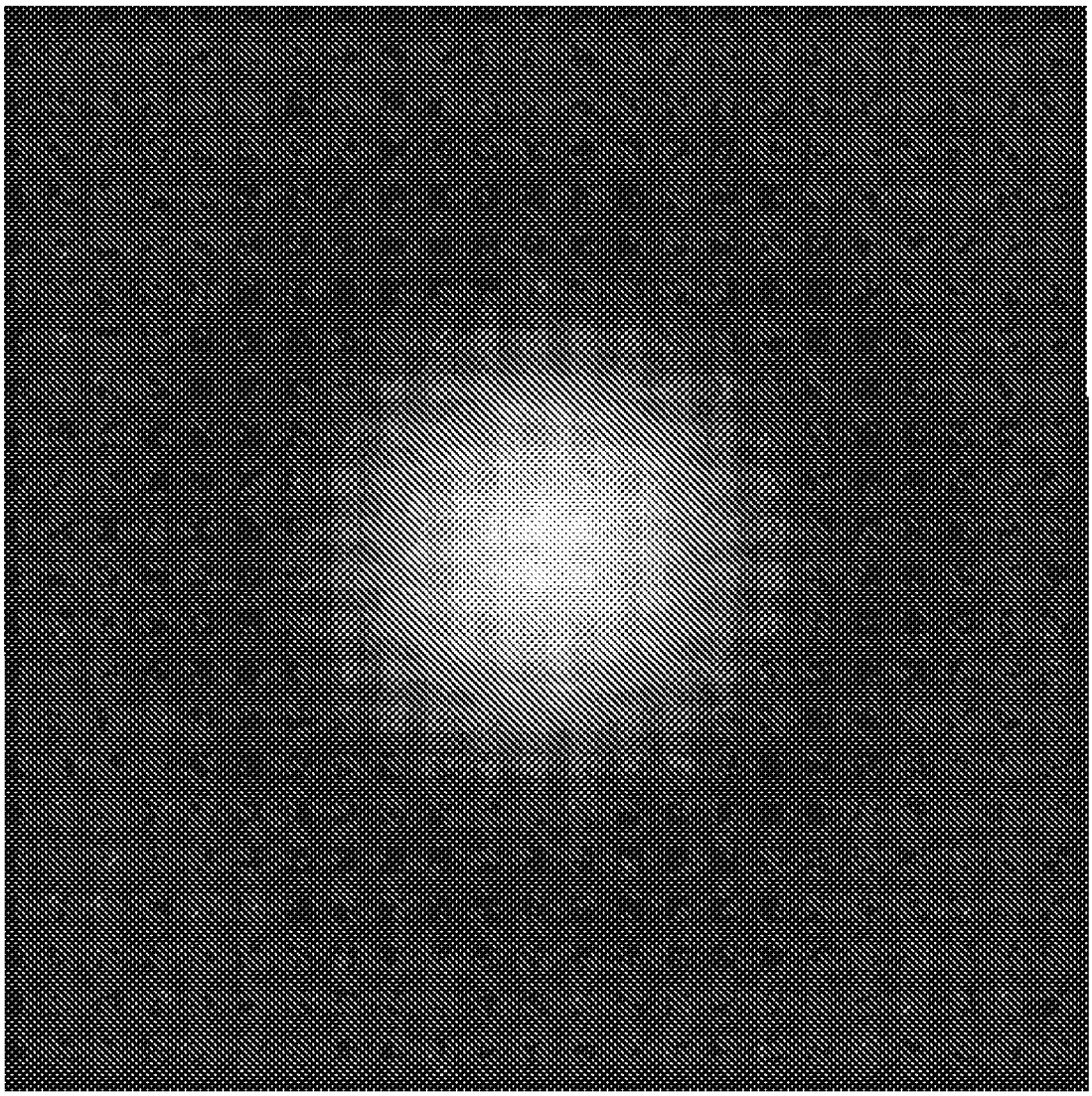
FIG. 19 is a photograph of the spatial illuminance in the X-Y plane of a light beam produced by an embodiment of the present invention.

FIG. 18 shows a typical illuminance chart at a distance of 2 meters. FIG. 19 shows a photograph of this illuminance at a 2 meter distance.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

This application may disclose several numerical range limitations. Persons skilled in the art would recognize that the numerical ranges disclosed inherently support any range within the disclosed numerical ranges even though a precise range limitation is not stated verbatim in the specification because this invention can be practiced throughout the disclosed numerical ranges. The entire disclosure of the patents and publications referred in this application are hereby incorporated herein by reference.

The invention claimed is:

1. An optical assembly for producing light having improved collimation and homogenization, comprising:

a primary reflector having a reflective surface disposed and configured to receive widely-collimated light from LEDs and to produce first reflected light, each LED being disposed within a cup-shaped cavity having an interior reflective wall, at least a portion of the reflective surface of the primary reflector having facets, the reflective surface further comprising a shape similar to a cone having a narrow end pointed toward the LEDs;

a secondary reflector having an entrance aperture extending therethrough, the entrance aperture disposed and configured to allow the widely-collimated light from the LEDs to pass therethrough toward the primary reflector, an inner concave reflective surface disposed and configured to reflect the first reflected light to produce second reflected light, and an exit aperture at a top of the inner concave reflective surface, at least a portion of the inner concave surface of the secondary reflector having facets; and a primary support means for positioning the primary reflector at a predetermined location within the widely-collimated light, wherein the reflective surface of the primary reflector comprises a first portion that defines the shape similar to a cone, a second portion that defines a concave reflective surface, and a third portion that defines a convex reflective surface, the second portion being intermediate the first and third portions.

2. The optical assembly of claim 1, wherein a shape of at least a portion of the reflective surface of the primary reflector comprises a free-form bezier spline.

3. The optical assembly of claim 1, wherein a shape of at least a portion of the secondary reflector comprises a free-form bezier spline.

4. The optical assembly of claim 1, wherein a secondary support means provides support to the secondary reflector.

5. The optical assembly of claim 4, wherein the secondary support means comprises a plurality of struts.

6. The optical assembly of claim 5, wherein at least a portion of the plurality of struts is coupled to the primary support means.

7. The optical assembly of claim 1, wherein:

the reflective surface of the primary reflector comprises a cross-sectional profile having a free-form Bezier spline, and is rotationally symmetrical;

the primary and secondary reflectors define a combination of two revolved spline reflectors equal to or less than 2-inches tall and equal to or less than 5-inches wide; and the second reflected light that passes through the exit aperture has a beam angle of less than or equal to 10-degrees.

8. An optical system for producing light having improved collimation and homogenization, comprising:

a light source disposed and configured to produce widely-collimated light, the light source comprising multiple LEDs arranged on a substrate, each LED being disposed within a cup-shaped cavity having an interior reflective wall;

a primary reflector having a reflective surface disposed and configured to receive the widely-collimated light and to produce first reflected light, at least a portion of the reflective surface of the primary reflector having facets, the reflective surface further comprising a shape similar to a cone having a narrow end pointed toward the LEDs;

a secondary reflector having an entrance aperture extending therethrough, the entrance aperture disposed and configured to allow the widely-collimated light to pass therethrough toward the primary reflector, an inner concave reflective surface disposed and configured to reflect the first reflected light to produce second reflected light, and an exit aperture at a top of the inner concave reflective surface, at least a portion of the inner concave surface of the secondary reflector having facets; and a primary support means for positioning the primary reflector at a predetermined location within the widely-collimated light, wherein the reflective surface of the primary reflector comprises a first portion that defines the shape similar to a cone, a second portion that defines a concave reflective surface, and a third portion that defines a convex reflective surface, the second portion being intermediate the first and the third portions.

9. The optical system of claim 8, wherein a shape of at least a portion of the reflective surface of the primary reflector comprises a free-form bezier spline.

10. The optical system of claim 8, wherein a shape of at least a portion of the secondary reflector comprises a free-form bezier spline.

11. The optical system of claim 8, wherein a secondary support means provides support to the secondary reflector.

12. The optical system of claim 11, wherein the secondary support means comprises a plurality of struts.

13. The optical system of claim 12, wherein at least a portion of the plurality of struts is coupled to the primary support means.

14. The optical system of claim 8, wherein:

the reflective surface of the primary reflector comprises a cross-sectional profile having a free-form Bezier spline, and is rotationally symmetrical;

the primary and secondary reflectors define a combination of two revolved spline reflectors equal to or less than 2-inches tall and equal to or less than 5-inches wide; and the second reflected light that passes through the exit aperture has a beam angle of less than or equal to 10-degrees.

15. A method for producing light having improved collimation and homogenization, comprising the following steps:

providing a light source producing widely-collimated light, the light source comprising multiple LEDs arranged on a substrate, each LED being disposed within a cup-shaped cavity having an interior reflective wall;

receiving the widely-collimated light through an entrance aperture extending through a secondary reflector such that the widely-collimated light from the LEDs moves from the entrance aperture toward a primary reflector;

reflecting the widely-collimated light using the primary reflector having a reflective surface to produce first reflected light, the reflective surface comprising a shape similar to a cone having a narrow end pointed toward the LEDs, wherein the first reflected light is reflected toward the secondary reflector; and reflecting the first reflected light to produce second reflected light using the secondary reflector;

wherein reflecting the widely-collimated light further includes homogenizing the reflected light with facets on the primary reflector;

wherein reflecting the light reflected by the primary reflector to produce the second reflected light further includes homogenizing the second reflected light with facets on the secondary reflector; and wherein the reflective surface of the primary reflector comprises a first portion that defines the shape similar to a cone, a second portion that defines a concave reflective surface, and a third portion that defines a convex reflective surface, the second portion being intermediate the first and third portions.

16. The method of claim 15, wherein:

the reflective surface of the primary reflector comprises a cross-sectional profile having a free-form Bezier spline, and is rotationally symmetrical;

the primary and secondary reflectors define a combination of two revolved spline reflectors equal to or less than 2-inches tall and equal to or less than 5-inches wide; and producing the second reflected light having a beam angle of less than or equal to 10-degrees.

* * * * *

UNITED STATES PATENT AND TRADEMARK OFFICE

CERTIFICATE OF CORRECTION

PATENT NO. : 8,333,488 B2
APPLICATION NO. : 12/523478
DATED : December 18, 2012
INVENTOR(S) : Edward Bailey It is certified that error appears in the above-identified patent and that said Letters Patent is hereby corrected as shown below:

In the Claims:

In column 9, line 29, in Claim 8, delete “the third” and insert -- third --, therefor.

Signed and Sealed this
First Day of July, 2014

Michelle K. Lee

Michelle K. Lee
*Deputy Director of the United States Patent and Trademark Office*